United States Patent [19]

Liggett

[11] Patent Number: 4,655,398

[45] Date of Patent: Apr. 7, 1987

[54] SPRAYING APPARATUS FOR IN SITU FORMATION OF VEHICLE FUEL TANKS

[75] Inventor: Paul E. Liggett, Wooster, Ohio

[73] Assignee: Goodyear Aerospace Corporation, Akron, Ohio

[21] Appl. No.: 808,384

[22] Filed: Dec. 16, 1985

Related U.S. Application Data

[63] Continuation of Ser. No. 562,774, Dec. 19, 1983, abandoned.

[51] Int. Cl.[4] ..... B05B 15/08

[52] U.S. Cl. ..... 239/588; 239/575; 239/587; 239/590.3

[58] Field of Search ..... 239/587, 588, 525, 575, 239/590.3

[56] References Cited

U.S. PATENT DOCUMENTS

| | | | |
|---|---|---|---|
| 1,319,738 | 10/1919 | Watrous | 239/588 X |
| 1,923,425 | 8/1933 | Diederich | 239/587 |
| 2,244,159 | 6/1941 | Hunter | 239/590.3 X |
| 3,023,971 | 3/1962 | Milhous | 239/525 X |
| 3,065,918 | 11/1962 | Hostetter | 239/575 |
| 3,166,252 | 1/1965 | O'Brien et al. | 239/587 |
| 3,537,652 | 11/1970 | Pearl | 239/588 X |
| 3,940,072 | 2/1976 | Ishikawa et al. | 239/587 |
| 4,412,656 | 11/1983 | Beck | 239/588 X |

*Primary Examiner*—Andres Kashnikow
*Assistant Examiner*—Daniel R. Edelbrock
*Attorney, Agent, or Firm*—P. E. Milliken; L. A. Germain

[57] ABSTRACT

A spray nozzle extension is affixed to the output of a conventional spray gun apparatus to allow an operator to spray a polymeric elastomer into enclosed spaces of an integral fuel tank cavity such as to form an in situ tank within the cavity. The nozzle tip is extended from the spray gun by a flexible hose and the complete unit includes variously arranged in-line filter and swivel connectors to achieve dispersion of lumps in the spray material and axial, yaw, and pitch rotation of the nozzle tip respectively.

6 Claims, 3 Drawing Figures

SPRAYING APPARATUS FOR IN SITU FORMATION OF VEHICLE FUEL TANKS

This is a continuation of co-pending prior application Ser. No. 562,774 filed Dec. 19, 1983, now abandoned.

BACKGROUND OF THE INVENTION

This invention relates to spraying apparatus and more particularly to a unique nozzle extension for use in combination with a spray gun to facilitate spraying of a polymeric material into an enclosed cavity to completely coat the interior surfaces thereof and thus form an integral leak-proof fuel container such as, for example, an in situ formed fuel tank.

While the invention is developed for spray-coating integral aircraft fuel tanks, i.e, tanks in situ formed within the fuselage or wing cavities of an aircraft, it may also be applied to any other type vehicle including automotive type vehicles wherein the tanks are formed within the body framework of the vehicle.

According to the prior art practice of fuel tank manufacture as it pertains to aircraft, such tanks are made as a single complete unit and thereafter installed into an enclosed cavity provided for it within the confines of the aircraft framework. Tanks of the type alluded to are made by various techniques wherein fuel resistant polymeric coatings are applied to reinforcement fabric, the fabric being firstly laid up onto a mold and/or mandrel which approximates the configuration of the cavity into which the tank is to be installed. Obviously, the volume capacity of a tank made according to this practice is determined by and dependent upon how closely one is able to make the tank fit the cavity configuration.

Recent improvements in fuel resistant materials, and more particularly with respect to air-curable polyurethane elastomers, have made it feasible to make fuel tanks which are an integral part of the vehicle. This type of tank is an attractive alternative to the prior art tanks in that the total enclosed volume space provided for the tank is utilized for fuel storage which obviously allows for greater fuel capacity in a particular aircraft while also decreasing the weight of such prior art fabric-reinforced tanks. Exemplary of polyurethanes alluded to are those disclosed in U.S. Pat. No. 4,247,678 assigned to The Goodyear Tire & Rubber Company, Akron, Ohio and also in co-pending applications Ser. Nos. 502,832, now U.S. Pat. No. 4,496,707, and 502,867, now U.S. Pat. No. 4,565,729, both of which were filed on June 9, 1983.

While these polyurethane materials and/or cements have proved effective for in situ formed fuel tanks, various areas of the tank cavity are difficult, if not impossible, to cover using conventional spraying apparatus. Difficulty is especially encountered in such areas as the nooks and corners of the tank cavity and around access ports provided through the cavity for various controls such as hydraulic and/or electrical lines. Furthermore, it is extremely difficult to spray-coat the back sides of fasteners such as screws, bolts, nuts and the like which are used in fabricating the aircraft even though personnel may be able to crawl into the larger fuselage tank cavities, with the spraying equipment.

It is therefore in accordance with one aspect of the present invention an object to provide spraying apparatus that dispenses a substantially precise volume of particulate elastomeric material which when evenly dispersed over the surfaces of the cavity and cured, provides a substantially leak-proof in situ formed fuel tank within the confines of the vehicle body cavity.

SUMMARY OF THE INVENTION

Various aspects and advantages of the invention are achieved in a nozzle extension unit for use in combination with a spray gun when dispensing a sprayable polymeric material into an enclosed cavity having limited accessibility comprising an input connector for attachment of the unit to the spray gun, a nozzle tip including roll and yaw rotatable swivels, at least one filter screen element mounted in-line within the unit, and a length of flexible high pressure hose interconnecting the input connector to the nozzle tip.

BRIEF DESCRIPTION OF THE DRAWINGS

An appreciation of the inventive concept and the attendant advantages thereof will be readily understood by reference to the following description when considered with the accompanying drawings in the several figures in which like reference numerals designate like parts and wherein.

DETAILED DESCRIPTION OF THE PREFERRED EMBODIMENT

Figures 1, 2:
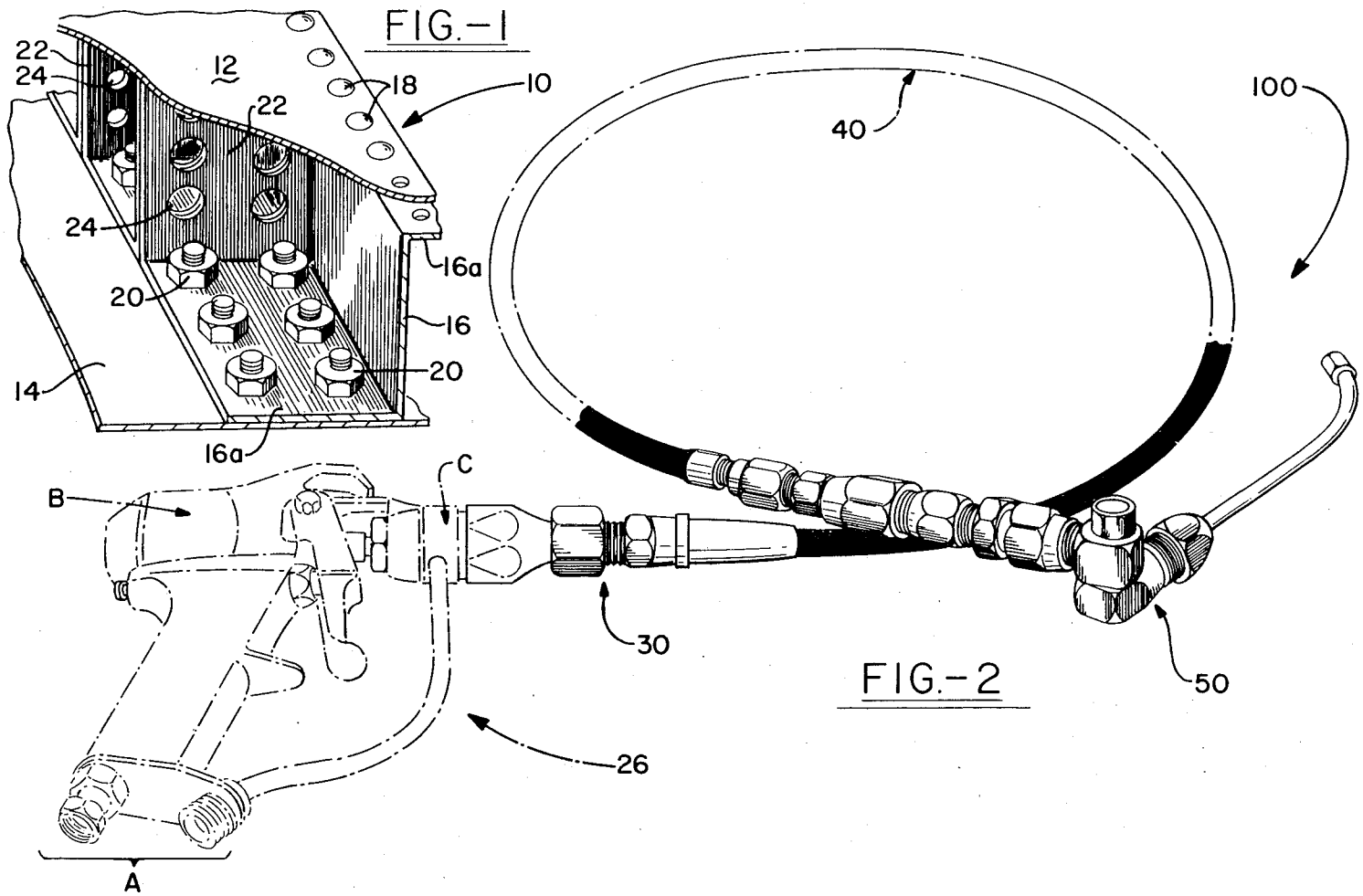
FIG. 1 is a perspective view, in section, of a portion of the body framework of a typical aircraft forming a wing tank cavity illustrating the complexity of the tank as it includes various fasteners, wall sections, and the like within the confines of the cavity.
FIG. 2 is a perspective view of a spray gun extension nozzle forming the basis of this invention as it may be attached to a state-of-the-art airless spray gun (shown in ghost lines)

Referring to FIG. 1 of the drawings, a portion of a typical aircraft wing tank is illustrated and generally indicated by reference numeral 10. Tanks of this type are formed within the framework of the wing structure and typically comprise a top plate 12, a bottom plate 14, and a plurality of walls 16 that interconnect the top plate to the bottom plate. The walls 16 are attached to the top and bottom plates via a plurality of rivets 18 and/or bolt-and-nut fasteners 20 which extend through flange portions **16*a* of the wall 16. A plurality of transversely extending walls 22 may also be included in the structural configuration and these will typically have a plurality of apertures 24 which decrease the weight of the structure as well as permit fuel to flow between various compartments formed by the intersecting walls 16 and 22**.

FIG. 1 is intended to illustrate the problem involved in attempting to seal the interior spaces of this type of complex-shaped structure and, because access into the tank cavity is limited, it becomes an exercise in futility to attempt to spray-coat all surfaces within the cavity using conventional spraying equipment. While aircraft fuselage tanks are larger and provide somewhat greater access, fuel leakage from these tanks cannot be tolerated inasmuch as the control functions of the aircraft are located within the fuselage. Therefore, it is imperative that the tank does not leak when attempting to in situ form such tank within the fuselage cavity. For this reason, aircraft fuselage tanks have conventionally been made as separate units which are leak tested prior to their installation into the aircraft framework assembly.

The present invention provides a nozzle extension for attachment to and use with a state-of-the-art spraying apparatus which allows personnel to direct a fuel resistant polyurethane elastomer into the most inaccessible areas of an aircraft fuel tank cavity. More specifically, the invention provides a unique "spray finger" unit that duplicates the swivel motion of a person's wrist and therefore allows complete freedom of spraying motion within enclosed spaces such as within aircraft wing and fuselage tank cavities.

The apparatus forming the present inventive concept is illustrated in FIG. 2 as it may be affixed to and operated in conjunction with a typical spray gun apparatus illustrated in ghost lines and generally indicated by reference numeral 26. The spray gun 26 is adapted for receiving various chemical components and/or materials which comprise the composite of the finished fuel tank and these enter the gun at "A", are controlled through a valve assembly at "B", and exit through a nozzle at "C".

Figure 3:
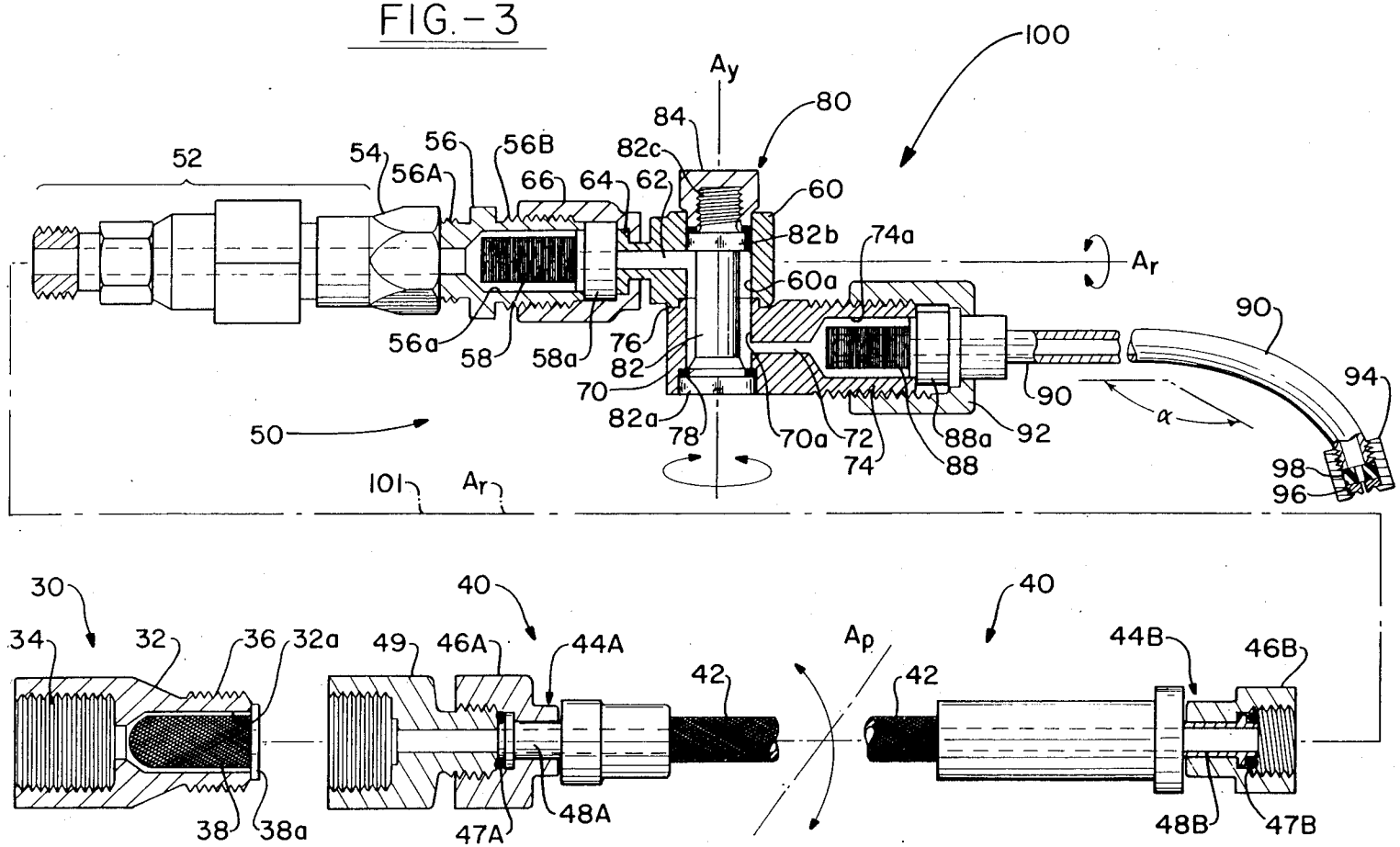
FIG. 3 is an elevational view, in partial section, of the nozzle extension shown in FIG. 2 illustrating the specific arrangement of the elements thereof.

The nozzle extension is generally indicated by reference numeral 100 and comprises a length of flexible high pressure hose 40 interconnecting a connector 30 at one end to the "spray finger" nozzle unit 50 at the opposite end. More particularly now with reference to FIG. 3 of the drawings, the nozzle extension 100 is illustrated in an elevational view with various portions shown in longitudinal cross-section and, because of its overall length, the figure is separated into the three sections 30, 40, and 50 which are interconnected by a dot-dashed line 101 to indicate the manner of assembly. Dot-dashed line 101 is also the axis of rotation $A_r$ of various in-line swivels forming an integral part of the unit 100 and these will be described more specifically hereinafter.

The connector 30 is such as to be readily attached to the output of the gun 26 at "C" and comprises a body 32 having a female threaded end 34 that threads onto the spray gun 26. The opposite end comprises a male threaded nipple 36 that defines a bore or chamber **32*a* that carries a relatively course 50 mesh filter screen element 38 therein in an axially in-line positon within the chamber. The screen element 38 also includes a washer end 38*a* which effects a seal at the output of the chamber 32*a*. The filter screen effectively breaks up any large lumps of spray material that may exit through the spray gun 26**.

Interconnection of the input filter connector 30 to the output nozzle unit 50 is accomplished through a length of flexible hose generally indicated by reference numeral 40. The hose section 40 may be of any length and comprises a flexible, high pressure, wire-braided rubber hose 42 having an axially in-line swivel connector 44A at the input end of the hose and substantially similar in-line swivel connector 44B at the output end thereof. The swivels 44A and 44B include female threaded nuts 46A and 46B and these are mounted on flanged nipple ends 48A and 48B respectively. The swivel 44A and 44B are sealed by O-ring seals 47A and 47B in a conventional manner. Input swivel 44A further includes a second female threaded nut 49 that adapts to the male nipple 36 of the filter connector 30. The swivel connectors 44A, 44B are conventional connections and eliminate kinking of the wire braid hose 42 when the hose section 40 is connected to the gun 26 and nozzle unit 50.

The output connecting nut 46B of the hose section 40 is adapted for threading engagement with a high pressure in-line axial swivel indicated by reference numeral 52. The swivel 52 is a product of the Spraying Systems Company of Wheaton, Ill. The swivel 52 is a sealed unit and the specifics of the elements forming the swivel are not important for this description suffice to say that it is designed for swivel operation at high pressures. The section 52 also includes a female threaded nut 54 at the output end that threads onto a second in-line filter connector 56.

The connector 56 comprises input and output threaded nipple ends 56A and 56B respectively. The output end 56B defines an enlarged bore or filter screen chamber **56*a* that carries a screen element 58 therein in axial in-line position within the chamber 56*a*. The screen element comprises a plurality of serially connected discs having openings therethrough of approximately 0.020 inch (0.51 mm) and further includes a washer type end 58*a*** that effects a sealing relationship with the end of the chamber in the usual manner.

The nozzle section 50 further comprises a "yaw swivel" generally indicated by reference numeral 80. The swivel 80 comprises an upper or input body portion 60 that is connected in swivel relationship to a lower or output body portion 70. The two body portions 60, 70 define chamber bores **60*a* and 70*a* respectively which have a common "yaw" swivel axis $A_y$. The upper body portion 60 includes an input bore 62 that is defined by a flanged nipple 64 which carries a mounted female threaded nut 66 thereon for attachment to the nipple end 56B of the filter connector 56. The lower body portion 70 includes an output bore 72 that is defined by a male threaded nipple end 74 which also defines a filter chamber 74*a*. The upper input body portion 60 and lower output body portion 70 are joined at 76 such that the portion 70 swivels with respect to the body portion 60 about the "yaw" axis $A_y$. The two body portions 60, 70 are maintained in their swivel relationship by a swivel bolt 82 that is captured in the bore 70*a* by its head portion 82*a* and in the bore 60*a* by a cap nut 84. The cap nut 84 is threaded onto the end 82*b* of the bolt 82. The swivel alignment of the bolt 82 is maintained in the upper body 60 by a flange 82*c* that also effectively seals that end of the bore 60*a*. The upper and lower bores 60*a* and 70*a* are further pressure sealed by seals 68 and 78** respectively.

The output nipple 74 of the body portion 70 houses a combination filter screen/check valve element 88 which is axially positioned within the chamber **74*a* and it includes a washer end 88*a* that seals the output end of the chamber. The element 88 comprises a 100-mesh screen 83** that encircles a ball check valve comprised of a spring that forces a ball to close off the output orifice at a predetermined low pressure.

An output tube 90 is connected to the yaw swivel 80 by a female threaded nut 92 which, when threaded onto the nipple 74, effects the seal as between the filter washer **88*a* and the end of the chamber 74*a*. The tube 90 is bent to an angle "$\alpha$" of approximately 120 degrees with respect to the rotational axis $A_r$ and it includes a small nozzle tip 94 that is threadably received on the end of the tube. The nozzle tip 94 comprises a nozzle disc 96 having a spray orifice and a seal disc 98** and this is a conventional arrangement.

From the foregoing description it should now be appreciated that an operator may move the spray nozzle 50 in any desired direction and/or angle to direct a spray of material with one hand while operating the spray gun 26 with the other hand. The in-line high pressure swivel 52 provides rotation about the $A_r$ roll axis of the nozzle unit 50 while the swivel 80 provides rotation about the $A_y$ yaw axis. In addition, the flexible hose 42 provides pitch motion ability about the $A_p$ pitch axis.

In the operation of the apparatus 100, in-line filter elements 38, 58, and 88 break up and/or filter out any pigment lumps that exist in a polyurethane cement as may be used for in situ formed fuel tanks. Such lumps have been a source of aggravation with conventional spraying equipment. Further, the check valve of the element 88 shuts off the flow of spray material at the nozzle tip 50 when the spray gun 26 is shut off and the internal pressure drops below a specific value. This shut off at the tip end of the unit 100 eliminates continued dripping of material out of the tip orifice 94 since the entire length of the nozzle extension unit 100 contains spray material.

While the invention may be used at pressures up to 4,000 psi, its best configuration includes a nozzle disc 96 having an orifice opening of about 0.009 inch (0.23 mm) and operating at a pressure of about 900 psi. This combination provides a very uniform coating of polyurethane cement. Of course other nozzle openings within the range of 0.005 to 0.020 inch (0.13 mm to 0.5 mm) may also be applied with attendant variations in the operating pressure and these will be determined by experience depending upon the type of material being dispensed through the apparatus.

What is claimed is:

1. A nozzle extension unit having an upstream input end and a downstream output end and connected at the upstream input end to a spray gun for dispensing a sprayable polymeric material at pressures of at least 500 psi comprising in combination:

an input connector at the upstream end adapted for attachment to the spray gun and having an axial bore therethrough and an axially positioned filter screen within the bore;

a nozzle tip at the downstream end having roll and yaw axes and comprising (a) an in-line positioned roll axis rotatable high pressure swivel having an input and an output, (b) an in-line positioned yaw axis rotatable high pressure swivel having an input and an output, (c) a connector interconnecting the output of the roll axis swivel to the input of the yaw axis swivel and having an in-line positioned filter screen within its bore, and (d) a spray orifice connected to the output of the yaw axis swivel through a length of tubing bent at an angle with respect to the nozzle tip roll axis; and a length of substantially flexible high pressure hose interconnecting the input connector at the upstream end to the input of the roll axis swivel to flexibly extend the nozzle tip a specific distance away from the spray gun;

said combination of flexible hose and roll and yaw axis rotatable swivels providing pitch, roll, and yaw motions to the nozzle tip to simulate wrist and hand motions of an individual using the unit and thus to facilitate spraying of the polymeric material into an enclosed cavity having limited accessibility.

2. The nozzle extension unit as set forth in claim 1 wherein the filter screen within the input connector is a 50 mesh screen and the filter screen within the connector interconnecting the roll axis rotatable swivel to the yaw axis rotatable swivel is a 100 mesh screen.

3. The nozzle extension unit as set forth in claim 1 wherein an in-line 100 mesh filter screen is also positioned within the output of the yaw axis swivel.

4. The nozzle extension unit as set forth in claim 1 wherein a valve is also positioned within the output of the yaw axis rotatable swivel such as to stop the flow of material when the spray gun is shut off and the internal pressure within the unit drops below a predetermined value.

5. The nozzle extension as set forth in claim 1 wherein the spray orifice has a diameter of within the range of 0.005–0.020 inch (0.13 mm–0.5 mm).

6. The nozzle extension unit as set forth in claim 1 wherein the spray orifice has a diameter of approximately 0.009 inch (0.23 mm).

* * * * *